United States Patent [19]

Metski

[11] Patent Number: 4,773,600

[45] Date of Patent: Sep. 27, 1988

[54] STUMPIT

[76] Inventor: Edward S. Metski, 10 Heather Dr., Center Moriches, N.Y. 11934

[21] Appl. No.: 42,794

[22] Filed: Apr. 27, 1987

[51] Int. Cl.[4] ..... B02C 18/18

[52] U.S. Cl. ..... 241/101.7; 241/28; 241/241; 241/243; 241/300; 241/294

[58] Field of Search ..... 241/239, 240, 241, 242, 241/243, 293, 294, 300, 28, 287, 189 R, 190, . 101.7; 144/2 N, 176

[56] References Cited

U.S. PATENT DOCUMENTS

| | | | |
|---|---|---|---|
| 3,195,592 | 7/1965 | Hall | 241/287 X |
| 3,321,145 | 5/1967 | Gorman | 241/300 X |
| 3,570,566 | 3/1971 | McCreery . | |
| 3,856,218 | 12/1974 | Harmon et al. . | |
| 3,929,294 | 12/1975 | Cox . | |
| 4,062,498 | 12/1977 | Szepaniak . | |
| 4,168,035 | 9/1979 | Palm et al. . | |
| 4,214,713 | 7/1980 | Wright . | |

*Primary Examiner*—Mark Rosenbaum
*Attorney, Agent, or Firm*—Leonard Belkin

[57] ABSTRACT

Apparatus for crushing chunks of trees and tree stumps comprising a solid cylinder having cutting elements extending from the surface. The housing containing the cylinder is provided along one side wall with stationary cutters extending out toward the surface of the cylinder between the columns of the cutting elements which are moving as the cylinder rotates. The space between the stationary cutters and the surface of the cylinder is adjustable in order to be able to select the size of particles being produced. A conveyer beneath the housing carries away the particles. The cutting elements are mounted in such away as to permit easy replacement in the event of a failure. Means are provided to drive said cylinder at no more than 50 RPM.

8 Claims, 3 Drawing Sheets

STUMPIT

BACKGROUND OF THE INVENTION

This invention relates to cutting apparatus and more particularly to apparatus for grinding uprooted trees and tree stumps and the like into chips for facilitating the useful disposition of such materials.

When land is cleared for home or other types of construction, trees and tree stumps are removed and then disposed of. In the past, and until quite recently in many parts of the country, the trees and stumps were hawled to sanitary land fills and dumps for burying, and in time the wood decayed and disappeared into the environment.

Recently, however, in many parts of the country, with increasing density of population, the dumping sites have approached capacity and no new sites are available. As a consequence, restrictions are being proposed and implemented which limit severely what can be deposited in those sites; in many other cases, the sites have been closed, or closing dates in the near future have been set, and alternative locations, quite often at great distances, have been located and used, usually at substantial additional costs because of the transportation which is involved.

The disposal of trees and tree stumps by alternative methods is particularly expensive because the material is bulky and heavy with the result that transporting the material large distances becomes quite costly.

As a result, there have been efforts to provide apparatus capable of reducing the wood in the trees and stumps into a form which is more manageable and easier to dispose of. Most devices presently available for reducing such wood as described above operate at high speeds, typically 1500 to 1800 RPM. Devices operating at that rate of speed tend to have a very short useful life, especially that frequent blade changes are required. Efforts up to now to produce a slow turning machine, that is, at or under 50 RPM, have generally been unsuccessful and those claimed to be slow turning cost in excess of $300,000.

Several United States patents show the types of devices generally available to reduce this material.

In U.S. Pat. No. 3,570,566 to McCreery is shown a device for chipping away at a tree stump using a rotating disk with teeth embedded therein. Apparently it is not suitable for use on trees which have been cut down, nor is there provision for carrying away the debris. U.S. Pat. No. 4,062,498 to Szepaniak describes a device for removing and chipping thin trees and twigs, and is incapable of dealing with large trees and stumps.

U.S. Pat. No. 4,214,713 to Wright discloses a grinder for pulverizing leaves, twigs, and garden debris using a plurality of rotating lawn mower type blades. The patentee neither describes, nor does it seem likely, that it could be used for reducing large pieces as would be the case for full size trees and stumps.

However, patents to Harmon et al (U.S. Pat. No. 3,856,218), Cox (U.S. Pat. No. 3,929,294), and Palm et al (U.S. Pat. No. 4,168,035), do show equipment designed to crush or otherwise reduce tree trunks and the like. These devices are quite complicated and very expensive to construct. In addition, blade construction is such that they are expensive and difficult to replace; in this kind of apparatus, that can be a serious drawback since it is usually the blades which tend to wear out first and most frequently.

SUMMARY OF THE INVENTION

This invention overcomes or reduces the problems associated with previously known devices designed to reduce wood trees, stumps and the like. In this invention, such result in a slow turning machine operating under 50 RPM is accomplished by utilizing a rotating drum or cylinder of solid metal construction having teeth which are easily and readily replaceable, and by rendering adjustable the size of the chips or particulate which are produced.

In accordance with a preferred of this invention, there is provided apparatus for crushing chunks of tree stumps and the like comprising a housing having a pair of extended side walls and open at the bottom, a cylinder of solid metal construction mounted for rotation in the housing about a substantially horizontal axis between and coextensive with the side walls, and means for driving the cylinder. The cylinder is provided in the outer surface thereof with a plurality of spaced cutting blades. A plurality of stationary cutting elements are mounted on one of the extended side walls which project toward the cylinder and occupy spaces between the cutting blades. A hopper is provided to direct the chunks of material to be crushed into the housing containing the cylinder. Beneath the housing is provision for receiving and carrying away the chips or particulate formed by the rotating cutting blades passing between the stationary cutting elements.

It is therefore a principal object of this invention to provide efficient and effective apparatus for crushing chunks of tree stump and the like.

Other objects and advantages of this invention will hereinafter become obvious from the following description of preferred embodiments of this invention.

DETAILED DESCRIPTION OF THE PREFERRED EMBODIMENTS

Figure 1:
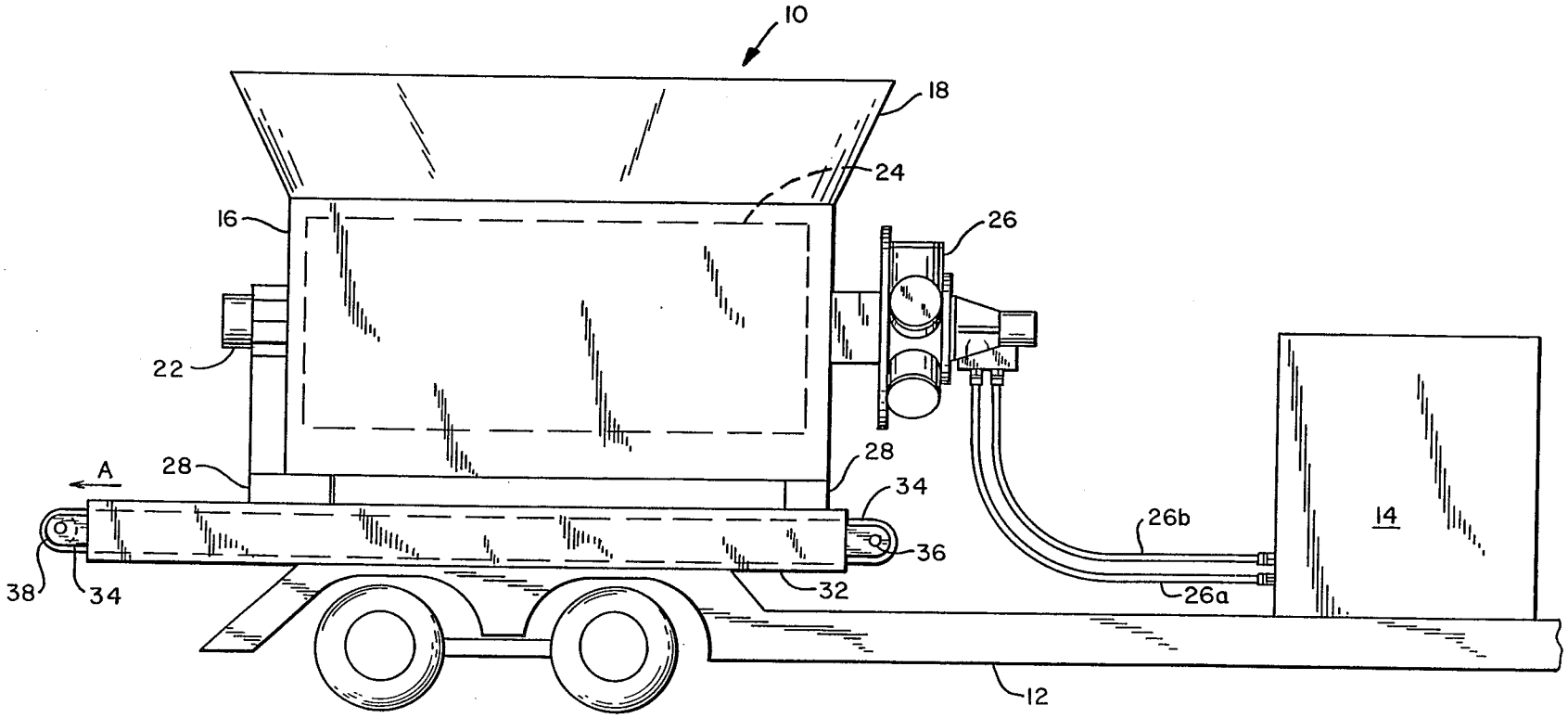
FIG. 1 is a side elevation view, partially schematic, of a preferred embodiment of this invention mounted on the bed of a trailer.

Referring to FIG. 1, crushing apparatus 10 embodying the principles of this invention is shown mounted on a trailer 12 which would also carry an auxiliary power source 14 to provide the power to operate apparatus 10.

Apparatus 10 consists of a housing 16 open at the bottom, a hopper 18 to receive the chunks of material to be reduced, and a shaft 22 shown protruding at the left end to support cylinder 24 within housing 16. At the right end of housing 16 is shown mounted a hydraulic motor 26 connected by hydraulic hoses **26*a* and 26*b* to power source 14. As is understood in the art, source 14 may consist of an internal combustion engine and a hydraulic pump to provide hydraulic fluid under pressure to motor 26 through one of the hoses. The other hose would be the return. Of course, any other suitable source of power may be employed to turn cylinder 24**.

Housing 16 is shown supported by legs 28 resting on an enclosure 32 open on top which contains a conveyer consisting of an endless belt 34 moving as indicated by arrow A. Belt 34 is supported by a shaft 36 at one end and operated by a hydraulic motor 38 at its other end. The purpose of belt 34, which is operated when cylinder 24 is turning, is to carry the chips or particulate dropping from housing 16 to the rear of trailer 12 for suitable collection.

Figure 2:
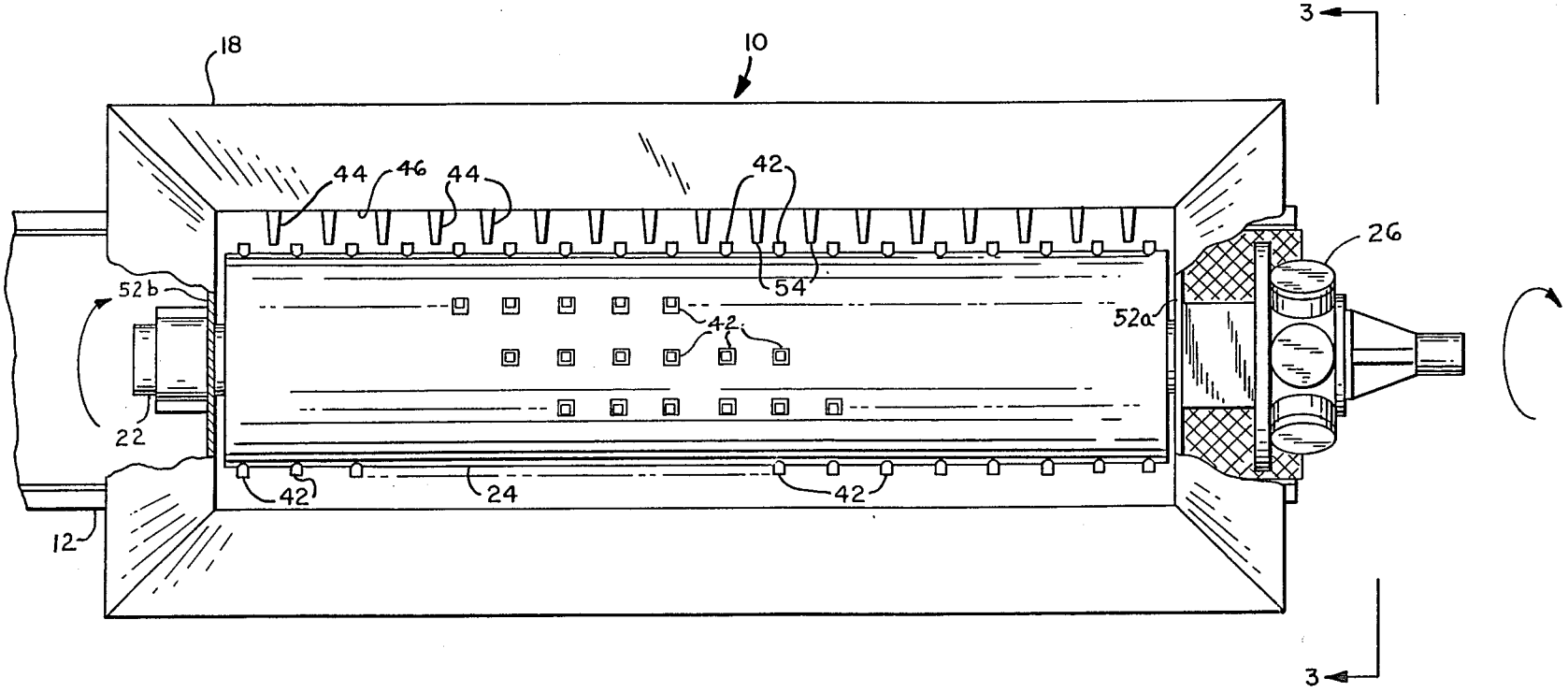
FIG. 2 is a top or plan view of the embodiment shown in FIG. 1.
Figure 3:
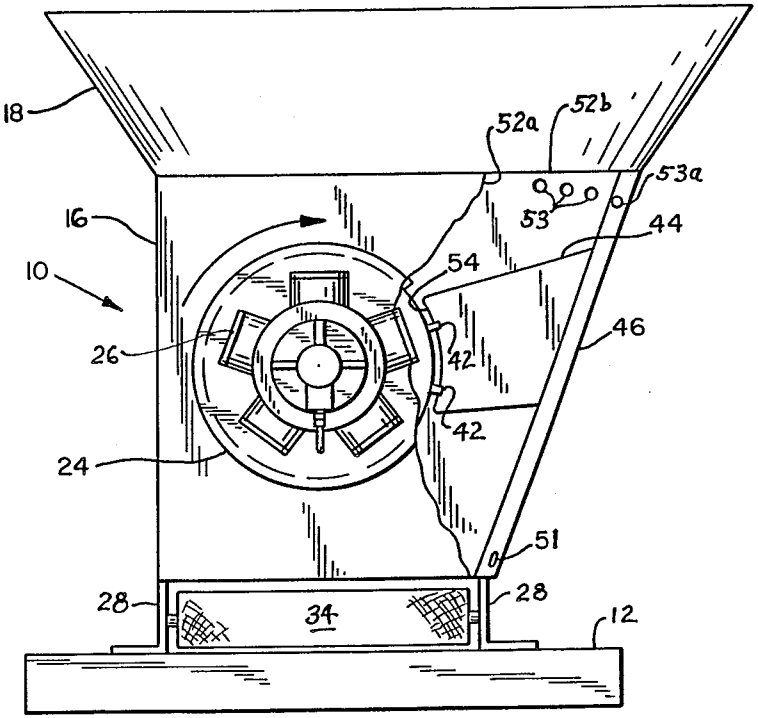
FIG. 3 is a right end view, partially schematic and broken away, taken along 3—3 in FIG. 2.

As seen in FIGS. 2 and 3, cylinder 24 which is of solid metal construction to provide an ample flywheel effect is provided on its complete surface with a plurality of spaced cutting teeth 42. Teeth 42 are spaced circumferentially around the surface of cylinder 24, and may be in rows which extend parallel to shaft 22 as seen in FIG. 2. In addition, teeth 42 are spaced in columns which extend circumferentially around the outer surface of cylinder 24 in order to accomodate stationary cutter elements 44 which are mounted on side wall 46 of housing 16 and project inwardly into housing 16 in the direction of cylinder 24.

Side wall 46 is pivoted at 51 so that cutter elements 44, passing between adjacent columns of teeth 42, may be ajusted to and away from the outer surface of cylinder 24 for the purpose of selecting the size chips to be discharged from the bottom of housing 16. End walls 52*a* and 52*b* of housing 16 are provided with a plurality of spaced openings 53 to accomodate pins 53*a* to engage a matching opening in each edge of side wall 46 to adjust the position of the latter. In order to adjust the spacing of cutter elements 44 from cylinder 24, pins 53*a* are removed, wall 46 adjusted to the desired position, and pins 53*a* are reinserted.

As seen from FIGS. 2 and 3, cutter elements 44 have edges 54 facing cylinder 24 which are shaped or contoured to match the curvature of surface of cylinder 24. Elements 44 may be supported on wall 46 by welding or by any other convenient means.

Figure 4:
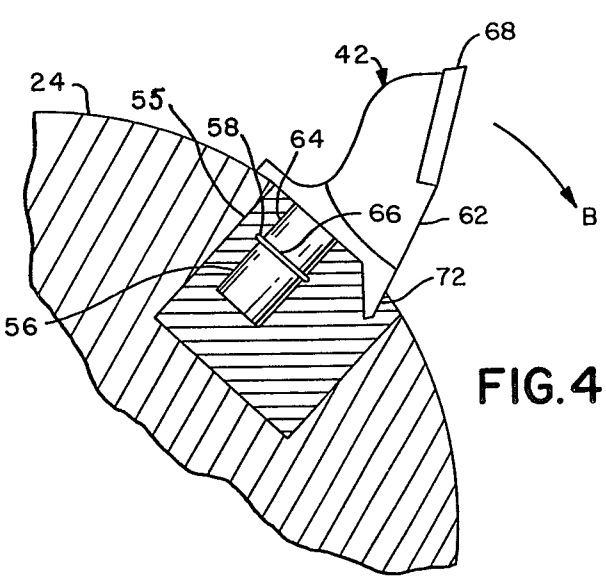
FIG. 4 is a detail in section showing a cutting tooth and its mounting.

For details of teeth 42, reference is made to FIG. 4. Tooth 42 consists of a base 55 embedded and welded into the surface of cylinder 24 in the manner shown. Base 55 is provided with a socket 56 with an annular depression 58. The cutting element 62 of tooth 42 consists of a cylindrical portion 64 which is inserted into socket 56 and has an annular depression to match depression 58 to accomodate an O-ring 66. Embedded in the the outer tip of cutting element 62 facing in the direction of rotation as shown by arrow B is a carbide tip 68. Element 62 is provided with a projection 72 which fits into a slot in base 55 to accomodate it in order to prevent cutting element from rotating while in operation.

In the operation of the appartus just described, the tree stumps, tree trunks, and trees, as well as any other wood to be reduced would ordinarily be brought to the site of apparatus 10 for crushing or comminuting. If desired, however, the apparatus can be brought to the site of the materials to be processed.

Separate cutting apparatus may be employed if needed to reduce the size of the chunks of material to fit into hopper 18.

The chunks of material are dropped into hopper 18 while cylinder 24 is turning and conveyer belt 34 is moving. Adjustable side wall 46 is positioned to obtained the size of comminuted material desired. Smaller size chips or particles are produced as stationary elements 44 are brought closer to the surface of cylinder 24. This capability is an important feature of the invention for the reasons which follow.

Once the wood material is comminuted by apparatus 10, this material, considered by many to be a waste material, may be dumped into waste collection sites where it will occupy much less space than the tree stumps, etc. from which it is derived, or it can be converted into a more useful form. For example, it has been found that when mixed with duck manure and piled in rows, and periodically turned over, within about six months there will be produced a soil which after screening is a commercially acceptable potting soil. For best results, it is necessary to comminute the material to a particular average size. In certain other possible applications of the wood chips produced by apparatus 10, another size material would be more efficient or effective.

Hence, this invention makes it possible to select within a certain range the size of the material to be produced as a result of the processing carried by this invention.

Another feature of this invention relates to the simple and economic means to replace a cutting tooth which has been damaged. During the normal use of this apparatus, it has been found that the cutting teeth remain securely in place, yet, when a tooth replacement is required, it can be readily pried loose so that another tooth can be inserted.

Still another feature of this invention is that with the use of a solid cylinder it is possible to drive the latter at a relatively slow turning rate, by which is meant herein, no more than 50 rpm and still obtain a high torque. Other machines on the market rely for effective cutting action rotational speeds much higher, some as high as 1500–1800 rpm. Such high speeds increase dramatically the incidence of tooth damage with the consequent down time associated with the repair and maintenance work required. In addition, with much less abuse of the machine involved at the lower operating speed, machines embodying the principles of this invention should have a more extended useful life.

While only a preferred embodiment of this invention has been described, many changes and variations of the invention are possible without departing from the principles of this invention as defined in the claims which follow.

What is claimed is:

1. Apparatus for crushing chunks of wood comprising:

a. a housing having a pair of extended side walls and open at the bottom;

b. a cylinder of solid metal construction mounted for rotation in said housing about a substantially horizontal axis between and coextensive with said side walls;

c. means for driving said cylinder;

d. said cylinder having on the outer surface thereof a plurality of spaced cutting teeth means, each of said spaced cutting teeth means consisting of a base embedded in and flush with the surface of said cylinder, said base having a socket with an annular depression, a readily replaceable cutting element having a cylindrical portion inserted into said socket, said cylindrical portion having an annular depression facing and aligned with the annular depression in said socket, an O-ring mounted within said socket filling both of said annular depressions in order to hold said cutting element within said socket, and said cutting element having a cutting face extending outwardly from the surface of said cylinder, the outer surface of said cylinder being interrupted only by the protrusion of each cutting element;

e. a plurality of stationary cutter means mounted on one of said extended side walls projecting toward said cylinder and occupying spaces between adjacent cutting teeth means;

f. hopper means mounted on said housing means above said cylinder for receiving said chunks of wood to be crushed and directing said chunks for deposit on said cylinder; and g. means located beneath said housing for receiving the resulting crushed material, whereby rotation of said cylinder results in the crushing of said chunks between said rotating cutting teeth means and said stationary cutter blade means.

2. The apparatus of claim 1 having means to adjust the particulate size of said crushed material.

3. The apparatus of claim 2 wherein said adjust means comprises means for pivotally mounting the side wall carrying said stationary cutter means for permitting adjustment of the spacing between said cutter means and the outer surface of said cylinder thereby permitting adjustment of said particulate size.

4. The apparatus of claim 1 wherein said cutting face has mounted therein a carbide tip facing the direction of rotation.

5. The apparatus of claim 4 having means comprising a projection extending from said cutting element into a slot in said base to prevent axial rotation of said cutting element means on said cylinder thereby maintaining said carbide tip in the direction of rotation.

6. The apparatus of claim 5 wherein said cylinder is mounted on a shaft extending out from said housing, said driving means comprising hydraulic motor means mounted for rotating said shaft, and said receiving means comprising a conveyor for carrying away said crushed material.

7. The apparatus of claim 6 wherein said housing, driving means, and receiving means are mounted on a trailer, said conveyor delivering said crushed material to an end of said trailer for deposit at a selected location.

8. The apparatus of claim 1 wherin said driving means maintains the rotation speed of said cylinder at no more than 50 RPM.

* * * * *